US005095253A

United States Patent [19]

Brent

[11] Patent Number: 5,095,253

[45] Date of Patent: Mar. 10, 1992

[54] FLUORESCENT LIGHTING POWER CONTROLLER FOR OPTIMUM ENERGY SAVINGS

[76] Inventor: Charles R. Brent, 3901 Jamestown Rd., Hattiesburg, Miss. 39402

[21] Appl. No.: 486,162

[22] Filed: Feb. 28, 1990

[51] Int. Cl.[5] ..... H05B 41/16

[52] U.S. Cl. ..... 315/276; 315/239; 315/200 R; 315/DIG. 5

[58] Field of Search ..... 315/97, 127, 239, 245, 315/200 R, 277 R

[56] References Cited

U.S. PATENT DOCUMENTS

| | | | |
|---|---|---|---|
| 4,013,921 | 3/1977 | Corthell | 315/239 |
| 4,135,115 | 1/1979 | Abernethy et al. | 315/97 |
| 4,378,514 | 3/1983 | Collins | 315/276 |
| 4,613,792 | 9/1986 | Kroessler | 315/97 |
| 4,847,536 | 7/1989 | Lowe et al. | 315/127 |
| 4,972,123 | 11/1990 | Gerfast | 315/200 R |

*Primary Examiner*—Eugene R. LaRoche
*Assistant Examiner*—Son Dinh
*Attorney, Agent, or Firm*—Frank H. Foster

[57] ABSTRACT

An electrical circuit used in conjunction with high power factor ballasts and quality fluorescent lamps to reduce the power consumption of a fluorescent fixture by an average of 40% with a lesser reduction of light output because of optimized current control through the discharge lamps increasing the efficacy of conversion of electricity to light, accomplishing this by means of a tuned inductor-capacitor resistor circuit, these along with a 1 to 1.3 impede current surges, transformer, add harmonics a circuit diode and feedback loop to reshape the circuit waveform for optimum performance of said lamps and optimum economic savings and payback through applicaiton of this technology to multiple fixtures in offices, factories, commercial buildings and stores.

1 Claim, 1 Drawing Sheet

FLUORESCENT LIGHTING POWER CONTROLLER FOR OPTIMUM ENERGY SAVINGS

CROSS REFERENCES TO RELATED TECHNOLOGIES

There is only one technology closely related at the level of sophistication of this technology known to this inventor and that is the Edison 21 Model 2130, an unpatented technology which this invention improves upon by retuning the circuit to optimize energy savings in four foot long 40 Watt fluorescent lighting fixtures at a nominal level of 40% savings. Other technologies including the Edison 7 monitor and the latest patent which describes a Duralux power controller, U.S. Pat. No. 4,847,536 attempt to combine the functions of inductor and transformer into one unit and are less successful at improving the overall efficacy of the fluorescent lighting circuit. Patent cited:

U.S. Pat. No. 4,847,536 to Duralux Industries

BRIEF SUMMARY OF THE INVENTION

The invention is an improvement upon the most sophisticated of fluorescent lighting controllers marketed for the purpose of energy savings in fluorescent lighting fixtures, in particular those controllers, monitors, and energy savers using tuned impedance and wave-shaping to obtain optimum efficacy (lumens/watt) providing energy savings greater than loss in light output (lumens). One particular unpatented device, the Edison 21 monitor, exhibited these characteristics, but by personal experience as an energy manager and many reports from dealers showed that this technology failed to meet acceptable economic payback criterion in many retrofit applications in which four forty watt lamps, two ballasts and two such devices were employed in each fixture. Payback periods of 3.5 to 6.5 years proved unacceptable to most commercial and industrial customers. This invention is an improvement upon that technology which provides 40% savings instead of 30% savings with essentially the same light output as an Edison 21 30% monitor, the 40% savings provide an attractive 2.5 to 5 year payback period. In so doing a new set of harmonics was introduced by retuning the circuit and a heavy duty circuit board was completely redesigned to carry the higher voltages and currents flowing through the device and provide a more convenient layout of components and conductors for improved ease of manufacturing.

The invention consists of an electronically tuned impedance circuit consisting of an inductor of nominally 90–110 milliHenries rating made by wrapping 230 turns of 22 gauge copper wire wrapped around an insulating bobbin with a 28 layer laminated E-I 0.50 core assembled around and within it, and varnished. This inductor is wired interrupting the power line leading to the ballast and connected in series with it (interrupting the ground lead provides the greater circuit stability). At the output of the ballast the blue leads are cut and the remaining circuit of the controller is wired between the ballast and the lamps, the remaining circuit consisting of a 1:1.30 step-up output transformer with a feedback loop having one 4.5 MFD capacitor, a 1 Megohm resistor, and a 1N4003 diode all three in parallel feeding back to the input of the transformer on the same end as the output feedback connection. These components plus a 91° C. thermal cutoff are conveniently arranged with the two electromagnetic devices (transformer and inductor) located on opposite ends of the circuit board, the capacitor in the center of the board and the resistor, diode, and thermal cutoff along side of the transformer and inductor. Four input leads are color coded with two white leads on the outer edge connected to the inductor and the themal cutoff device respectively with the inductor and thermal cutoff connected in series through the circuit board. Two black leads are connected to the input of the step up transformer, one having the feedback circuit attached. Two blue leads are attached to the other end of the circuit board to the output leads of the step-up transformer. The components are securely soldered onto the circuit board as indicated by circuit board labelling, and the whole circuit board is mounted and potted in a container box with dimensions of 5.25 inches by 2.25 inches by 1.375 inches and a lid secured on the box with glue (or plastic solvent). Ears with mounting holes extend from the ends of the box and two mounting screws along with six blue wire nuts are included in the packaging for installation. This controller, named the Excell-40 fluorescent lighting controller, is mounted in the channel of four-foot 1, 2 and 4 lamp fixtures and wired as previously mentioned to 1 ballast and two lamps or to 1 ballast and 1 lamp or two controllers are affixed to 2 ballasts and 4 lamps.

The resulting savings as measured by a true watt meter range from 38% to 41.5% and light losses are only 27% to 34%. Energy audits of real stores, factories, offices, etc. reveal a payback period of 2.5 to 5 years, optimally acceptable to most building managers and decision-makers.

The improvement of this previously unpatented technology is the retuning of the circuit with a 4.5 MFD capacitor, a heavy-duty circuit board for extended life, ease of manufacture, and the increased efficacy is a bonus confirmed by post-facto circuit analysis. These technological improvements along with manufacturing improvements and the above mentioned economic optimization constitute the improved invention, the subject matter of this patent application.

THE DRAWINGS

FIG. 1 is the circuit diagram for the improved technology showing from left to right, two white leads attached to the circuit board input attaching to inductor L1 (100 mH) and thermal cutoff F1, these two components are connected in series through the heavy duty circuit board. Also two black leads connecting to the inside holes of the input end of the circuit board, the circuit board connecting the black leads to the input of the 1:1.30 step up transformer. Two blue leads of 18 ga. solid strand wire connect to the right end, output end, of the circuit board, thence to the output of the transformer. Three components, a 4.5 MFD, 450 V capacitor, C1 (non polar), a 1 Megohm ¼ watt resistor R1 and a 1N4003 diode CR1 are placed parallel to each other and connected internally by the circuit board in a parallel wiring configuration between the output feedback conductor and the input (to the transformer) conductor on the same end of the transformer, the diode's (+) end attached to the input conductor. All coponents are arranged on the circuit board as indicated by white printing of the layout on the top side of the circuit board. The components are then soldered the thermal cutoff is then mounted in its binding posts and the circuit board mounted, potted with two part epoxy potting compound and sealed into a 5.25×2.25×1.375 inch fire resistant box with the leads extending from appropriately placed holes or slots in the box. After setting overnight the controller unit is tested for continuity, circuit component tolerances and then tested for savings in a lighting fixture test bed. Upon successful completion of the tests the unit is labelled, packaged and shipped as ordered by dealers or distributors.

FIG. 2 shows the conductor pattern on the bottom of the circuit board.

FIG. 3 gives the printed layout of components which is painted on the top of the circuit board.

DETAILED DESCRIPTION

Figure 1:
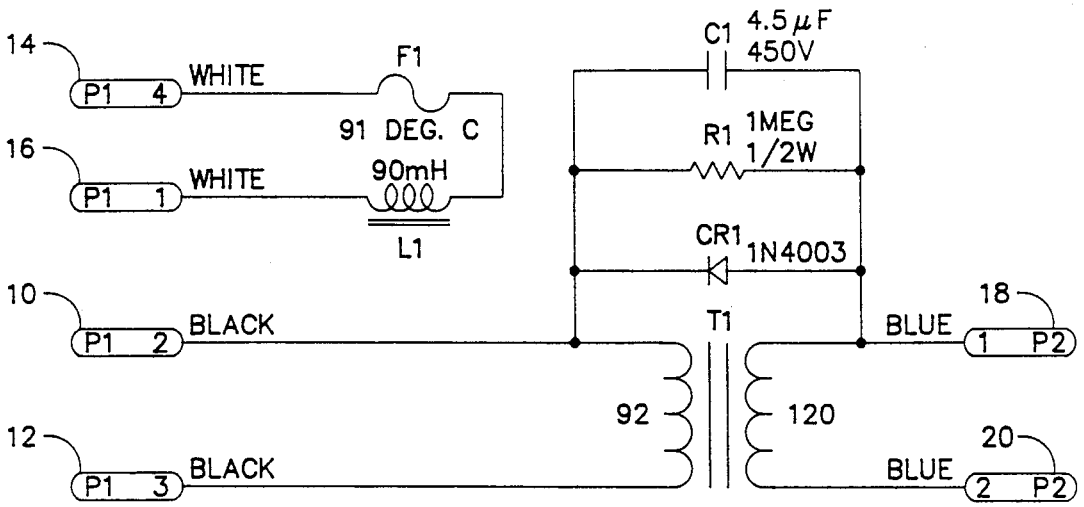
Figure 2:
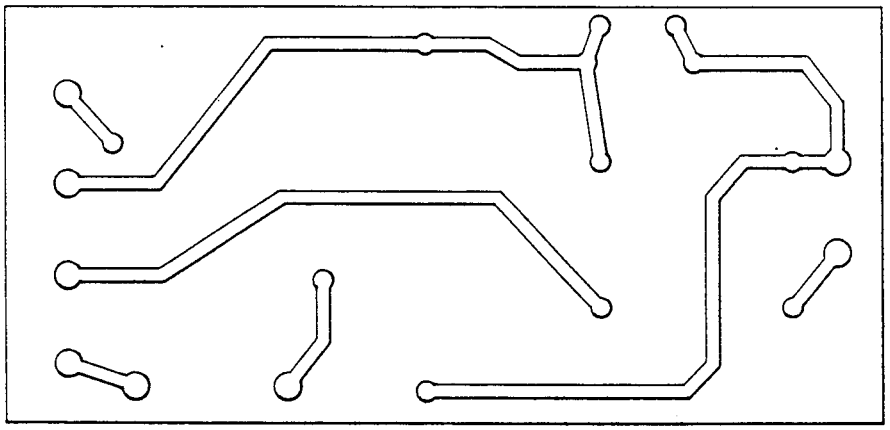
Figure 3:
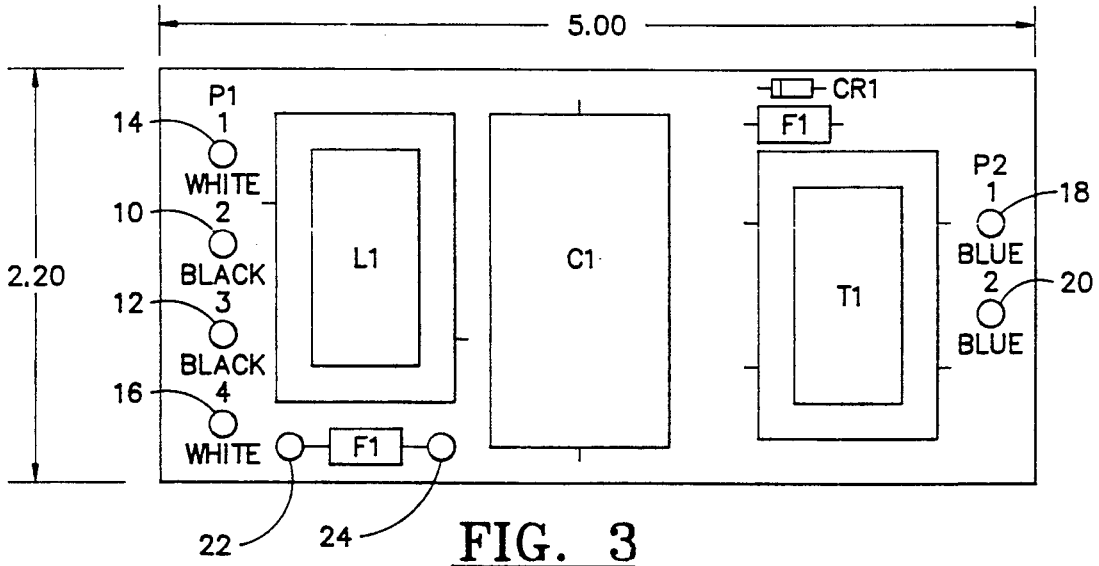

Several patented and unpatented devices have been sold during the decade(s) since the energy crises of 1973 and 1979 which are wired into a fluorescent lighting fixture (containing lamps, ballasts lampholders and color coded wiring) to control or reduce the power consumption of the circuit by reducing the current, the voltage, clipping the AC voltage, AC waveform shaping, or various other means. One of these unpatented devices, the Edison 21 Monitor was particularly successful, except in one application, at producing savings by lowering power consumption, extending lamp and ballast life. The one application in which it was unattractive was the case of buildings with four foot (long) fixtures usually with 2 to 4 lamps, and 1 ballast per two lamps. A two lamp circuit with two 40 watt fluorescent tubes and 1 ballast consumed only 96 watts. An Edison 21 Monitor retrofitted to this circuit saving 30% of the power consumption only saved 29 watts, and in offices or buildings with only 8 to 10 or 12 hrs of operation per day 5 to 6 days per week, an energy audit and economic analysis would usually show a payback period of 3.5 to 6 years. This inventor reasoned that a 40% power saver with a 33% increase in savings over a 30% monitor would provide a payback which would be much more economically attractive at 2.5 to 5 years to building managers and company presidents. A modification to retune the circuit to 40% savings, adding new harmonics, and a redesigned heavy duty circuit board for ease of manufacturing yielded the desired result and a bonus of increased efficacy (lumen per watt,output). Recoding of the wiring color code was accomplished to reduce the number of units destroyed through miswiring by electricians. The success rate in wiring seems to be higher by recoding the colors of the leads. There are other technologies which evolved from this unpatented Edison 21 technology. Most recently, a patent issued to for a Duralux Power Controller, but this is not the same technology. The Duralux technology omits the diode, the DC element in this improvement and the Edison 21 technology which aids in efficacy improvement and flicker control.

Whatever the case may be, the Edison 21 and this improved modification of it to produce a 40% controller with new, added harmonics have higher efficacy and a better record in service than those devices patented by Duralux, and the Edison technology preceded it by almost a decade.

The improved, modified device embodied in this patent application consists of an electrical or electronic circuit comprised of the following: six 18 gauge solid conductor wire leads each 16 inches in length with 600 V to 100 V insulation color coded with two black leads connected within the holes 10 and 12 near the center of the input end of the circuit board, the input end being the end having four holes for lead attachment labelled 10, 12, 14, and 16. Slotted mounting posts may be used to attach the leads, but these proved to have no manufactuting advantage. Two white 18 ga wires 16 inches long are connected into the outer two holes 14 and 16 on the input end of the circuit board. Two 18 gage blue wires are affixed into the other end of the circuit board, the output end, into holes labelled 18 and 20. The circuit board connects, with conductor, one white lead wire to one end of the inductor, L1, the inductor consisting of 230 turns of 22 ga copper magnet wire with varnish insulation wrapped around a plastic bobbin and fitted into an EI 50 core 28 laminates in thickness, resulting in an inductor of some 90 to 110 milliHenries. The other white lead is connected to a binding post which will hold a thermal cutoff fuse, F1, rated at 91° C. the other end of the thermal cutoff connecting in series to the inductor, L1, through a binding post and a circuit board connection. The binding posts, 22 and 24 are installed but the thermal cutoff is put in place only after all of the soldering is done.

Circuit board connections connect the two black leads to the input of a 1:1.30 step-up transformer, T1, consisting of 92 turns of 22 gauge magnet wire and 120 turns of 24 ga. wire wound consecutively onto a bobbin fit into an EI 50 core with two input and two output leads all extending from the bottom side of the transformer core for attachment in appropriate holes in the circuit board. With the transformer properly mounted with the secondary leads to the output end of the circuit board, the circuit board connects the transformer output to the two blue output leads, 18 and 20 and the circuit board makes the feedback connection to one end each of a 1 megohm resistor, R1, one 4.5 MFD capacitor C1, and the negative end of an 1N4003 diode, CR1. With these three components properly inserted in place, the other end of all three are circuit-board-connected to the conductor which runs between the black lead inserted into hole 10 and the transformer input. Once in place all components, except the thermal cutoff are soldered in place in a wave soldering apparatus or by hand soldering. The excess component leads are trimmed back to the solder connection, the thermal cutoff is pushed into place with the appropriate insertion tool and the whole assembly is placed in a flame resistant box whose bottom is already covered with ⅛ inch or more of freshly mixed potting material (2 part epoxy) to insulate the conductors on the bottom of the circuit board. Leads are brought out through appropriate slots or holes in the device container box and the remainder of the box is filled to within ⅛" of the top and the lid is snapped and glued in place. The box or lid or both have ears on the end with holes for mounting screws. The assembly is allowed to set overnight while the potting material cures to a solid matrix.

A label is attached to the bottom of the device and the controller device is tested for continuity, component tolerance and finally placed in a fixture test bed to measure power savings and light loss with a true wattmeter and calibrated light meter. Those units which pass the tests are packaged along with two mounting screws and six blue wire nuts each and shipped as orders are placed by distributors and dealers.

The modifications to improve existing technology consist of the 4.5 MFD capacitor, C1, retuning the circuit harmonics and producing 38% to 42% savings, a redesigned heavy duty circuit board, a two-step potting procedure to insure insulation of the circuit conductors on the bottom of the board, a bonus of increased efficacy. These coupled with a long history of energy audits with economic analyses which were turned down for unattractive payback periods point to an optimized 40% savings device especially designed for-four foot fixtures to which 30% monitors applied produced marginal to unattractive savings. Fifty percent saving monitors, a size which Edison 21 monitors did come in, suffered too much light loss in most all applications except halls, closets and storage areas.

The inventor of this technology claims:

1. An improved attachment for connection between a rapid start ballast and a filament of a conventional rapid start fluorescent lighting fixture for reducing consumption of power and improving electrical waveform, wherein said ballast includes an autotransformer having a primary winding, a secondary winding, and a plurality of step-down filament windings and a first capacitor in series with the high voltage output side of said autotransformer, and wherein said attachment comprises an isolation transformer having a primary for connection to the secondary of said step down transformer and a secondary for connection to a fluorescent lamp filament, a second capacitor connected between the primary and secondary of said isolation transformer, a resistor connected in parallel with said capacitor, a diode connected in parallel with said capacitor, and an inductor for series connection with said primary winding of said autotransformer, wherein the improvement comprises:

(a) said inductor having an inductance substantially within the range of 90–110 millihenries; and (b) said second capacitor having a capacitance substantially within the range of 4.3–4.7 microfarads whereby even harmonies are added to improve the waveform and thereby increase the ratio of emitted light per unit of energy consumed.

* * * * *